US006997007B1

(12) United States Patent
Wyatt

(10) Patent No.: US 6,997,007 B1
(45) Date of Patent: Feb. 14, 2006

(54) LIGHT ASSEMBLY AND COOLER SYSTEM

(76) Inventor: Christopher A. Wyatt, 21096 Ted Rd., Brooksville, FL (US) 34601

( * ) Notice: Subject to any disclaimer, the term of this patent is extended or adjusted under 35 U.S.C. 154(b) by 0 days.

(21) Appl. No.: 10/823,303

(22) Filed: Apr. 13, 2004

Related U.S. Application Data

(60) Provisional application No. 60/463,224, filed on Apr. 15, 2003.

(51) Int. Cl.
*F25D 23/00* (2006.01)

(52) U.S. Cl. ..... 62/264; 62/457.1; 62/457.7

(58) Field of Classification Search ..... 62/264, 62/371, 451, 457.1, 457.7; 362/94, 155
See application file for complete search history.

(56) References Cited

U.S. PATENT DOCUMENTS

| | | | | |
|---|---|---|---|---|
| 3,937,320 A | * | 2/1976 | Chao et al. | 206/216 |
| 4,238,934 A | * | 12/1980 | Hotta | 62/457.2 |
| 4,274,262 A | * | 6/1981 | Reed et al. | 62/3.64 |
| 4,571,740 A | * | 2/1986 | Kirby et al. | 455/344 |
| 4,667,484 A | * | 5/1987 | Tarozzi et al. | 62/371 |
| 4,939,912 A | * | 7/1990 | Leonovich, Jr. | 62/457.1 |
| 5,329,433 A | * | 7/1994 | Geeting et al. | 362/154 |
| 5,864,981 A | * | 2/1999 | Zeman | 43/54.1 |
| 5,979,175 A | * | 11/1999 | Ellison | 62/457.7 |
| 6,182,462 B1 | * | 2/2001 | Bania et al. | 62/264 |
| 6,305,185 B1 | * | 10/2001 | Sloan | 62/457.7 |
| 6,445,295 B1 | * | 9/2002 | Abshire et al. | 340/571 |
| 6,519,965 B1 | * | 2/2003 | Blanchard et al. | 62/264 |

FOREIGN PATENT DOCUMENTS

| | | | |
|---|---|---|---|
| JP | 363241037 A | * | 10/1988 |
| JP | 2000-43 A | * | 1/2000 |
| JP | 2001-61393 A | * | 3/2001 |

* cited by examiner

*Primary Examiner*—Mohammad M. Ali
(74) *Attorney, Agent, or Firm*—Edward P. Dutkiewicz

(57) ABSTRACT

A cooler is formed with a front and rear wall and two end walls. A bottom wall is coupled to the lower edges of the front, rear and end walls. The front, rear and end walls form a rectangular opening. A lid has an outwardly extending periphery pivotally coupled to the lid. The lid is adapted to rest in contact with the rectangular opening when the cooler is in the closed orientation. A light assembly has an interior illumination member and a switch. The switch is operable to inactivate the panel when the lid is in the closed orientation.

3 Claims, 4 Drawing Sheets

FIG 1
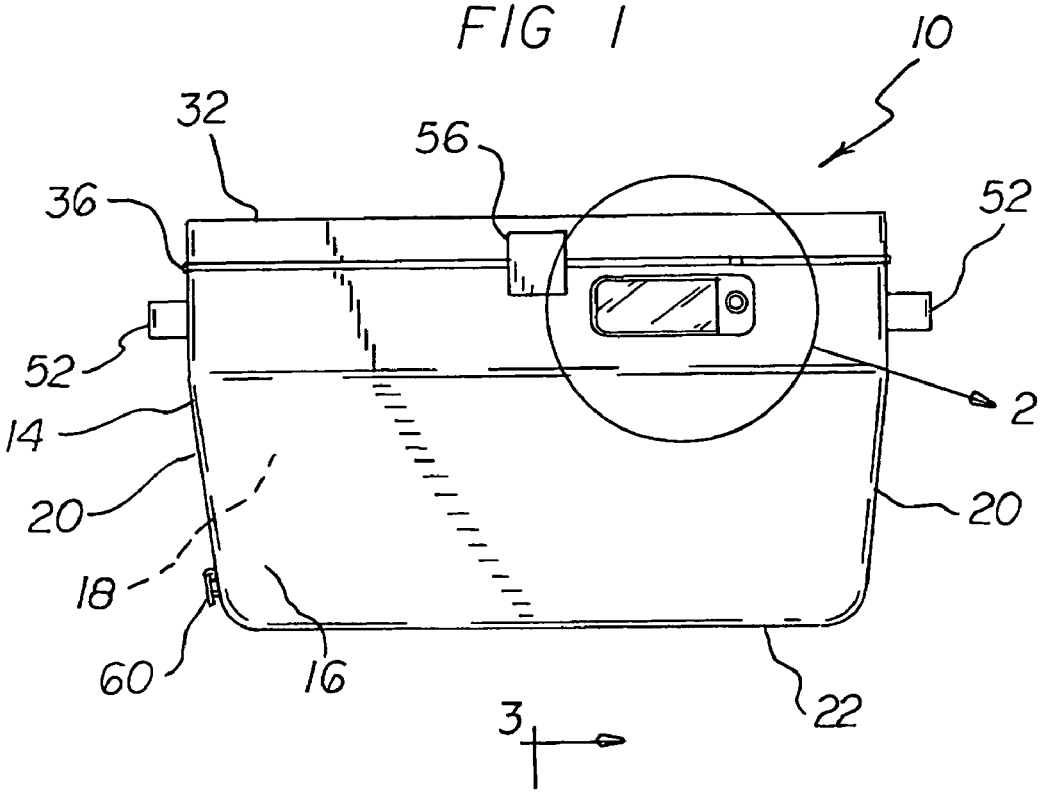
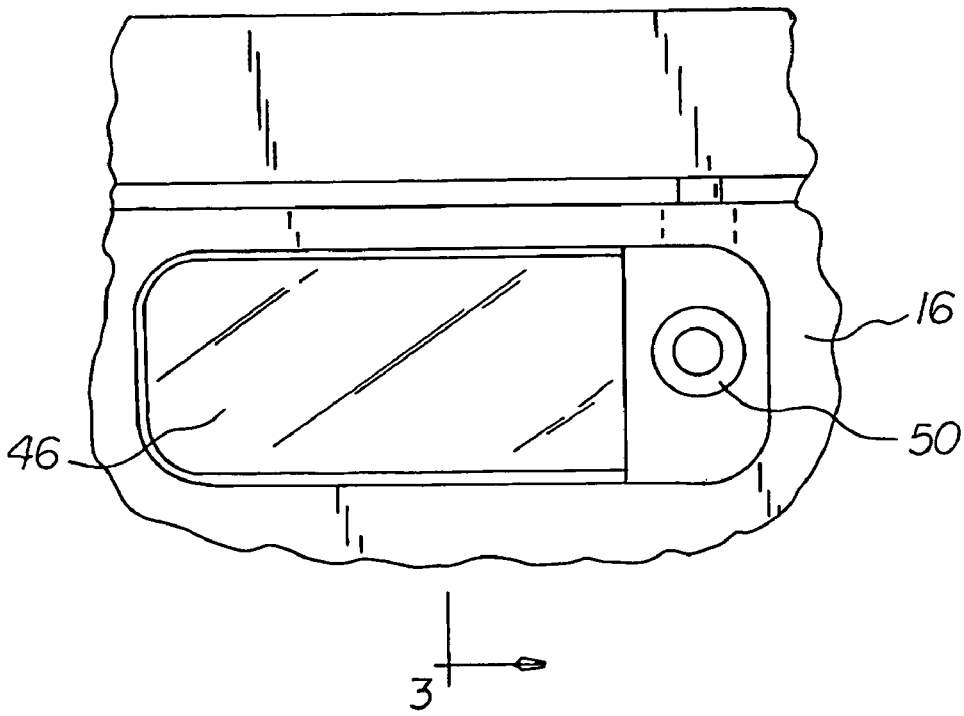
FIG 2

FIG 3
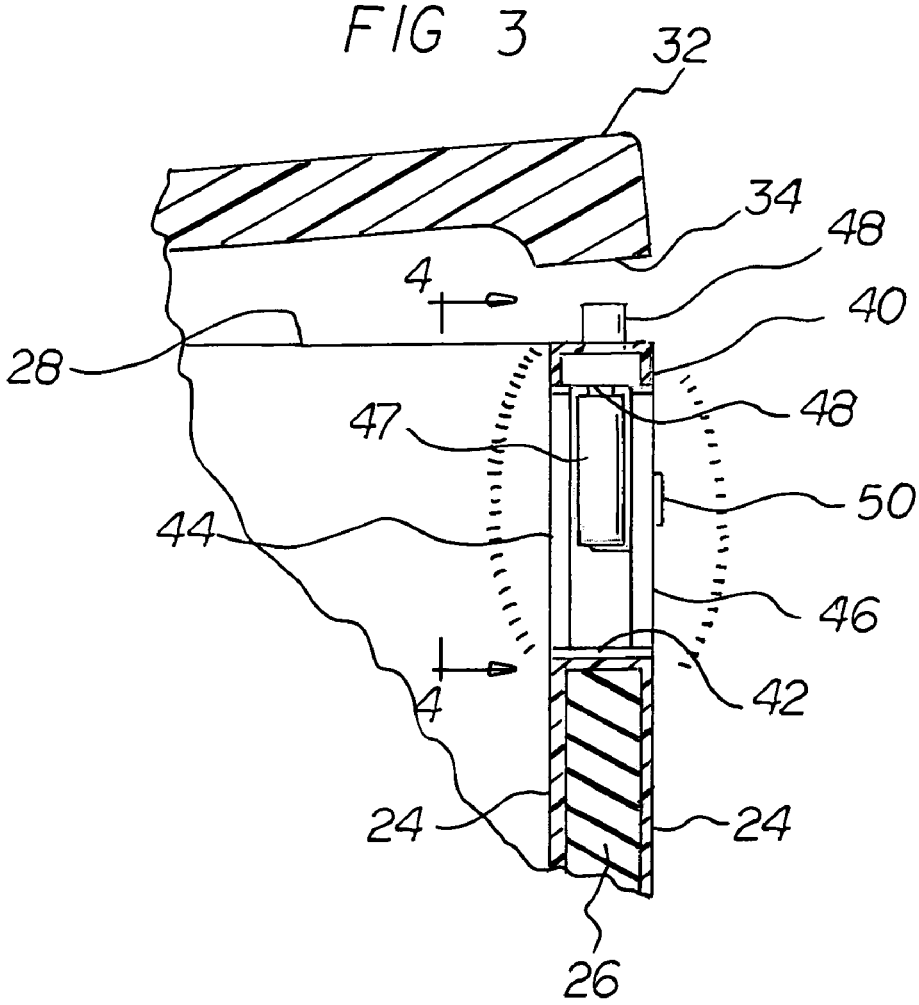
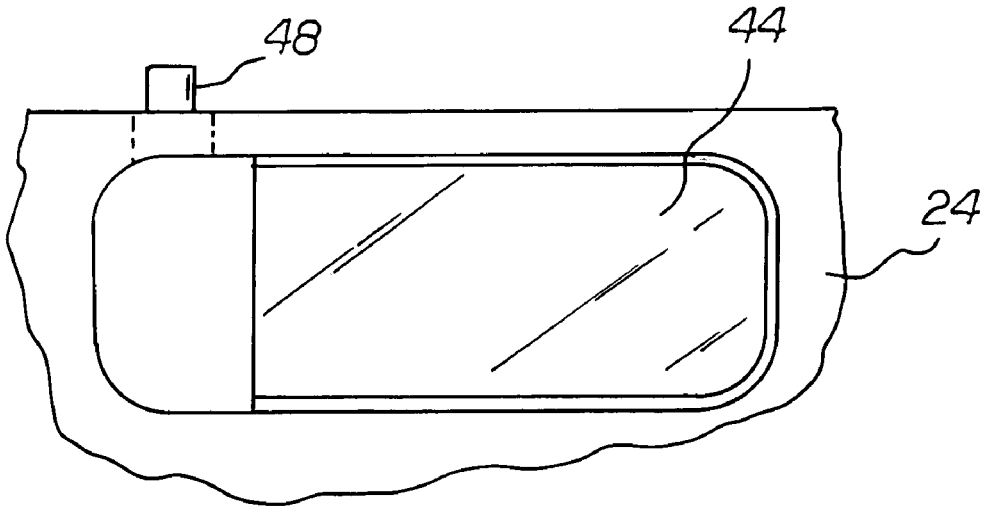
FIG 4

FIG 5
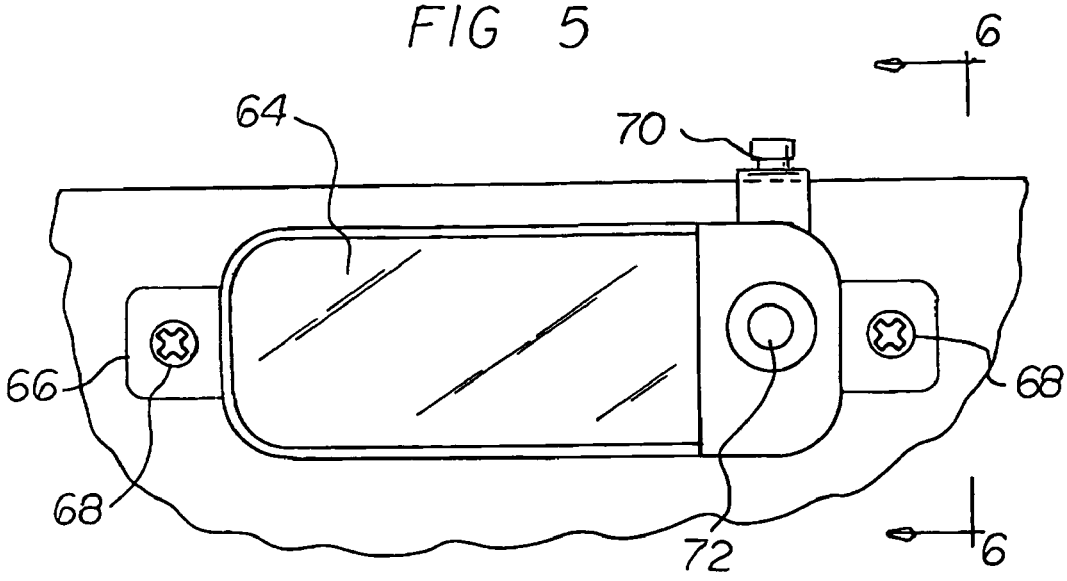
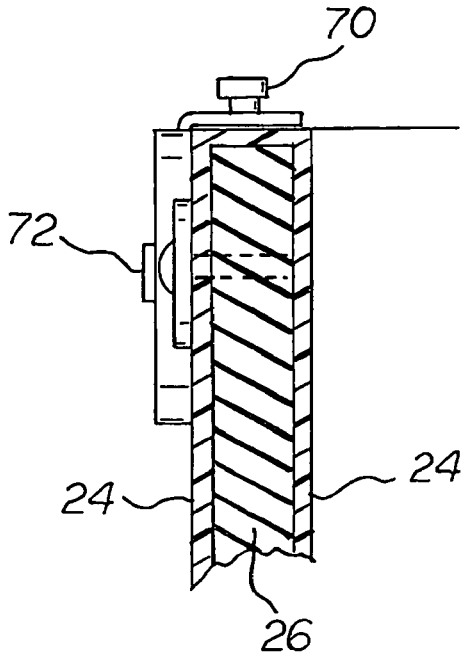
FIG 6

LIGHT ASSEMBLY AND COOLER SYSTEM

RELATED APPLICATION

The present non-provisional patent application is based upon pending provisional application Ser. No. 60/463,224 filed Apr. 15, 2003.

BACKGROUND OF THE INVENTION

1. Field of the Invention

The present invention relates to a light assembly and cooler system and more particularly pertains to facilitating the viewing of the contents of a cooler during dark conditions.

2. Description of the Prior Art

The use of container systems of known designs and configurations is known in the prior art. More specifically, container systems of known designs and configurations previously devised and utilized for the purpose of viewing of the contents of a container are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the prior patents do not describe light assembly and cooler system that allows facilitating the viewing of the contents of a cooler during dark conditions.

In this respect, the light assembly and cooler system according to the present invention substantially departs from the conventional concepts and designs of the prior art, and in doing so provides an apparatus primarily developed for the purpose of facilitating the viewing of the contents of a cooler during dark conditions.

Therefore, it can be appreciated that there exists a continuing need for a new and improved light assembly and cooler system which can be used for facilitating the viewing of the contents of a cooler during dark conditions. In this regard, the present invention substantially fulfills this need.

SUMMARY OF THE INVENTION

In view of the foregoing disadvantages inherent in the known types of container systems of known designs and configurations now present in the prior art, the present invention provides an improved light assembly and cooler system. As such, the general purpose of the present invention, which will be described subsequently in greater detail, is to provide a new and improved light assembly and cooler system and method which has all the advantages of the prior art and none of the disadvantages.

To attain this, the present invention essentially comprises a cooler. The cooler is formed with a generally vertical large front wall and a parallel generally vertical large rear wall. Two parallel generally vertical small end walls are provided between the front and rear walls. The front, rear and end walls all have upper, lower and side edges. The cooler is also formed with a horizontal large bottom wall. Peripheral edges are coupled to the lower edges of the front and rear and end walls. All of the walls are fabricated of essentially rigid spaced plastic sheets. An insulating foam is provided between the plastic sheets. The upper edges of the front, rear and end walls form a rectangular opening.

A lid is provided. The lid has a thermally insulating plastic material. The lid is in a generally rectangular configuration. The lid has an outwardly extending periphery. The lid also includes a hinge. The hinge pivotally couples one edge of the lid to the upper edge of the rear wall. In this manner the lid is allowed to move between an opened orientation and a closed orientation. The lid is adapted to rest in contact with the rectangular opening when the cooler is in the closed orientation. The lid is adapted to rest out of contact with the rectangular opening when the cooler is in the opened orientation.

Provided next is a light assembly. The light assembly includes a generally rectangular aperture. The aperture is provided in the front wall adjacent to the upper edge and closer to one side wall than to the other side wall. The light assembly also includes an interior illumination panel and an exterior illumination panel. The exterior surfaces are coplanar with the plastic sheets of the front panel. A lithium battery is operatively coupled to the panels for the illumination thereof. The light assembly also has a first switch. The first switch is extendable upwardly of the upper edge of the front wall. In this manner the panels are inactivated when the lid is in the closed orientation to depress the first switch. The first switch extends upwardly when the lid is in the opened orientation. In this manner panels are activated to illuminate interior and exterior of the cooler. The light assembly also has a second switch. The second switch is located adjacent to the exterior panel. The second switch is adapted to be pressed by a user to inactivate the panels and to activate the panels to illuminate interior and exterior of the cooler.

Handles are provided on the side panels adjacent to the opening. The handles assist a user in transporting the system.

Further provided is a latch. The latch is on the lid adjacent to the upper edge of the front wall. The latch allows for the manipulation by a user in locking the lid in a closed orientation and unlocking the lid for movement to the opened orientation.

Provided last is a drain plug. The drain plug is in the rear wall adjacent to the bottom wall. The drain plug assists a user in draining the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light assembly and cooler system which has all of the advantages of the prior art container systems of known designs and configurations and none of the disadvantages.

It is another object of the present invention to provide a new and improved light assembly and cooler system which may be easily and efficiently manufactured and marketed.

It is further object of the present invention to provide a new and improved light assembly and cooler system which is of durable and reliable constructions.

An even further object of the present invention is to provide a new and improved light assembly and cooler system which is susceptible of a low cost of manufacture with regard to both materials and labor, and which accordingly is then susceptible of low prices of sale to the consuming public, thereby making such light assembly and cooler system economically available to the buying public.

Even still another object of the present invention is to provide a light assembly and cooler system for facilitating the viewing of the contents of a cooler during dark conditions.

Lastly, it is an object of the present invention to provide a new and improved light assembly and cooler system. A cooler is formed with a front and rear wall and two end walls. A bottom wall is coupled to the lower edges of the front, rear and end walls. The front, rear and end walls form a rectangular opening. A lid has an outwardly extending periphery pivotally coupled to the lid. The lid is adapted to rest in contact with the rectangular opening when the cooler is in the closed orientation. A light assembly has an interior illumination member and a switch. The switch is operable to inactivate the member when the lid is in the closed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a light assembly and cooler system constructed in accordance with the principles of the present invention.

FIG. 2 is an enlarged front elevational view taken at circle 2 of FIG. 1.

FIG. 3 is a cross sectional view taken along line 3—3 of FIG. 2.

FIG. 4 is an enlarged rear elevational view taken along line 4—4 of FIG. 3.

FIG. 5 is an enlarged front elevational view similar to FIG. 2 but illustrating an alternate embodiment of the invention.

FIG. 6 is a cross sectional view taken along line 6—6 of FIG. 5.

The same reference numerals refer to the same parts throughout the various Figures.

DESCRIPTION OF THE PREFERRED EMBODIMENT

Figure 7:
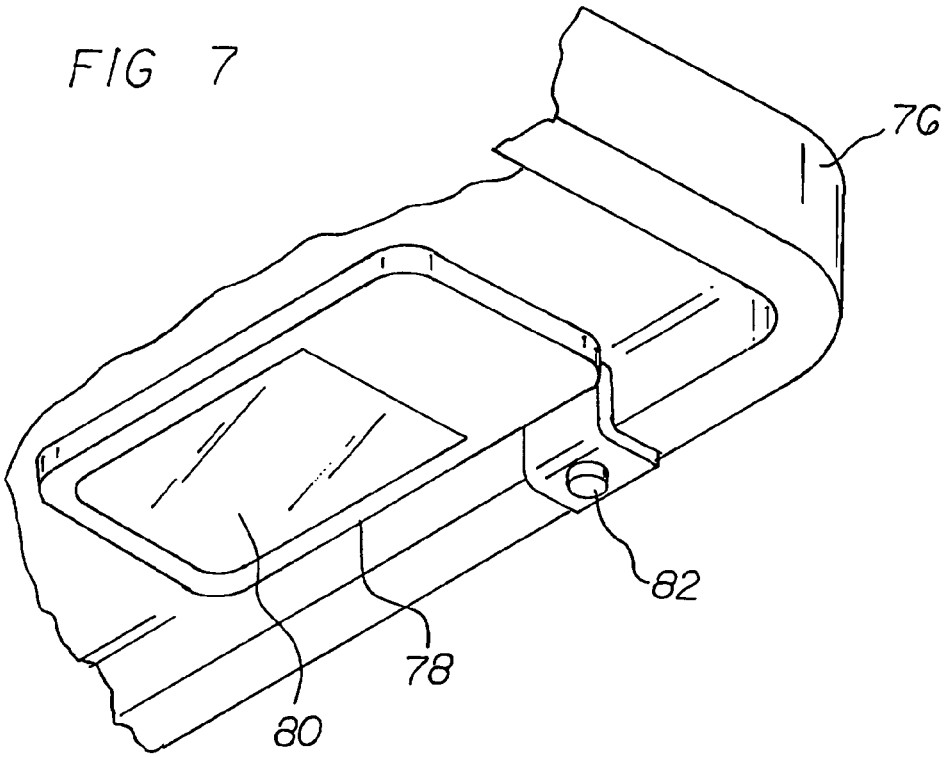
FIG. 7 is a perspective illustration of another alternate embodiment of the invention.

With reference now to the drawings, and in particular to FIG. 1 thereof, the preferred embodiment of the new and improved light assembly and cooler system embodying the principles and concepts of the present invention and generally designated by the reference numeral 10 will be described.

The present invention, the light assembly and cooler system 10 is comprised of a plurality of components. Such components in their broadest context include a cooler, a lid and a light assembly. Such components are individually configured and correlated with respect to each other so as to attain the desired objective.

First provided is a cooler. The cooler is formed with a generally vertical large front wall 16 and a parallel generally vertical large rear wall 18. Two parallel generally vertical small end walls 20 are provided between the front and rear walls. The front, rear and end walls all have upper, lower and side edges. The cooler is also formed with a horizontal large bottom wall 22. Peripheral edges are coupled to the lower edges of the front and rear and end walls. All of the walls are fabricated of essentially rigid spaced plastic sheets 24. An insulating foam 26 is provided between the plastic sheets. The upper edges of the front, rear and end walls form a rectangular opening 28.

A lid 32 is provided. The lid has a thermally insulating plastic material. The lid is in a generally rectangular configuration. The lid has an outwardly extending periphery 34. The lid also includes a hinge 36. The hinge pivotally couples one edge of the lid to the upper edge of the rear wall. In this manner the lid is allowed to move between an opened orientation and a closed orientation. The lid is adapted to rest in contact with the rectangular opening when the cooler is in the closed orientation. The lid is adapted to rest out of contact with the rectangular opening when the cooler is in the opened orientation.

Provided next is a light assembly 40. The light assembly includes a generally rectangular aperture 42. The aperture is provided in the front wall adjacent to the upper edge and closer to one side wall than to the other side wall. The light assembly also includes an interior illumination panel 44 and an exterior illumination panel 46. The exterior surfaces are coplanar with the plastic sheets of the front panel. A lithium battery 47 is operatively coupled to the panels for the illumination thereof. The light assembly also has a first switch 48. The first switch is extendable upwardly of the upper edge of the front wall. In this manner the panels are inactivated when the lid is in the closed orientation to depress the first switch. The first switch extends upwardly when the lid is in the opened orientation. In this manner panels are activated to illuminate interior and exterior of the cooler. The light assembly also has a second switch 50. The second switch is located adjacent to the exterior panel. The second switch is adapted to be pressed by a user to inactivate the panels and to activate the panels to illuminate interior and exterior of the cooler.

Handles 52 are provided on the side panels adjacent to the opening. The handles assist a user in transporting the system.

Further provided is a latch 56. The latch is on the lid adjacent to the upper edge of the front wall. The latch allows for the manipulation by a user in locking the lid in a closed orientation and unlocking the lid for movement to the opened orientation.

Provided last is a drain plug 60. The drain plug is in the rear wall adjacent to the bottom wall. The drain plug assists a user in draining the system.

With reference to the alternate embodiment of the invention shown in FIGS. 5 and 6, the system as set forth in claim 2, the panel and switch are aftermarket components. The panel and switch are coupled to the front wall by threaded fasteners 68 laterally offset from the panel. The switch is operable by the lid and a second switch 72 is operably by the user.

FIG. 7 illustrates another alternate embodiment of the invention. In such embodiment, the illumination member is a single interior panel and the lid 76 supports the light assembly 78. In addition, the light assembly includes an interior illumination panel 80 and a switch 82 extending downwardly from the lid adjacent to the front wall.

Figure 8:
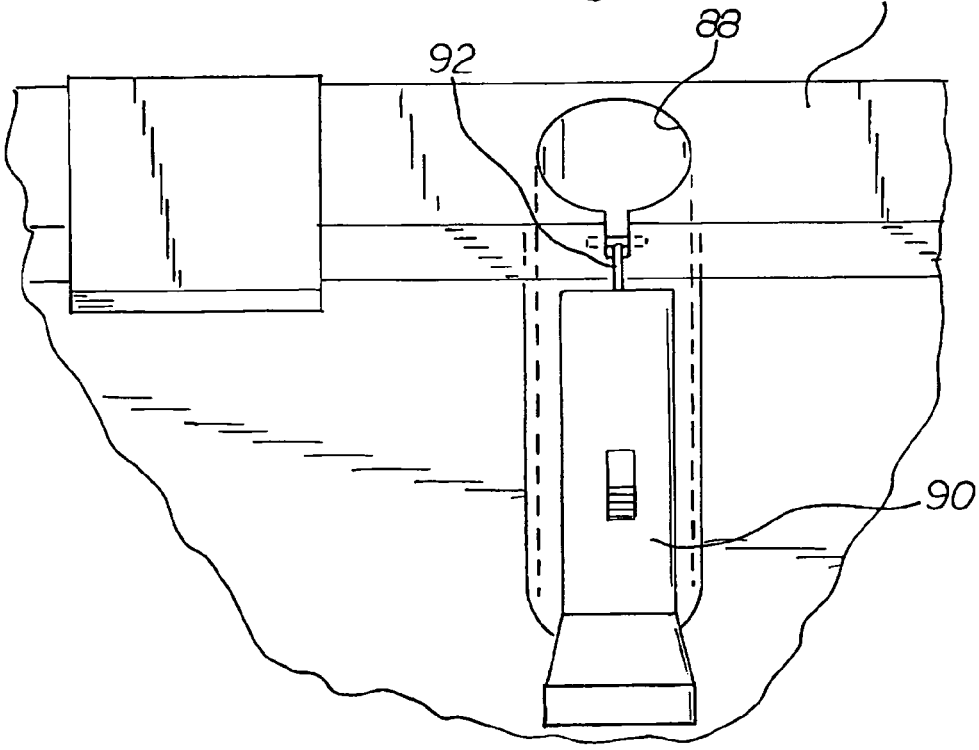
FIG. 8 is a perspective illustration of the final alternate embodiment of the invention.

The final alternate embodiment of the invention is shown in FIG. 8. In such embodiment, the illumination member is a flashlight. More specifically, the lid 86 includes an interior surface with a pocket 88. A flashlight 90 of an essentially conventionally nature with an essentially conventional operator controlled switch, is removably received within the pocket. The lid also includes a light holder 92. Such light holder is adapted to removably receive the flashlight in an orientation. In this manner, the flashlight functions to illuminate the cooler when the lid is in the opened orientation and to remain inactivated when the cooler is in the closed orientation.

The whole idea behind a cooler is portable refrigeration. You cannot take your refrigerator camping, fishing or to the park. A cooler works in much the same way as a refrigerator. It keeps food and beverage cold for you to enjoy at your convenience. One important feature a refrigerator has that a cooler lacks is a light. Can you imagine trying to find what you are looking for in a dark kitchen at night, with no light in the fridge? So is the case with a cooler, except a cooler is taken into much darker environments, with no option for switching on a light, until now. The present invention is an illumination source for a standard commercial cooler with interior and exterior lights. It would come already installed in a cooler or as an after-market kit that a consumer could easily install himself or herself. The present invention has a contact release button that would automatically turn the light on when the cooler lid was opened, much like a refrigerator light. The present invention has a manual on/off switch to control this automatic function.

The present invention is constructed of plastic, foam insulation, rubber and metal. The hinges on the lid are manufactured from plastic and/or metal. The electric light components are built to contemporary industry standards using plastic, insulated wire, and rubber seals. The lights are battery powered.

Inspiration struck while the inventor was camping at night. A flashlight was not at hand, and the simple task of finding an item in a cooler had become difficult and frustrating in the dark. The present invention's interior and exterior lights provide valuable illumination and add safety and convenience to any excursion.

The present invention is an assembly consisting of a plastic cooler body and lid, drain plug, and electric light. The cooler body and lid are filled with insulating foam. The cooler has a rubber seal around the lighting unit, plug and lid. The electric light is battery powered. The after-market kit version of the present invention screws into an existing cooler.

The usage of the present invention parallels a standard commercial cooler. The user installs the batteries prior to use. When ready to use, the present invention is filled with the desired food items, ice or frozen, liquid-filled freezer packs to keep the contents cold. If the user wanted the exterior light on, the manual switch would simply be turned to the "on" position. Otherwise, the light is engaged when the cooler lid is opened.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A light assembly and cooler system for facilitating the viewing of the contents of a cooler during dark conditions comprising, in combination:

a cooler formed with a generally vertical large front wall and a parallel generally vertical large rear wall with two parallel generally vertical small end walls there between, the front and rear and end walls all having upper and lower and side edges, the cooler also formed with a horizontal large bottom wall with peripheral edges coupled to the lower edges of the front and rear and end walls, all of the walls being fabricated of essentially rigid spaced plastic sheets with an insulating foam there between, the upper edges of the front and rear and end walls forming a rectangular opening;

a lid of a thermally insulating plastic material in a generally rectangular configuration with an outwardly extending periphery, the lid also including a hinge pivotally coupling one edge of the lid to the upper edge of the rear wall for allowing the lid to move between an opened orientation and a closed orientation, the lid adapted to rest in contact with the rectangular opening when the cooler is in the closed orientation, the lid adapted to rest out of contact with the rectangular opening when the cooler is in the opened orientation;

a light assembly including a generally rectangular aperture in the front wall adjacent to the upper edge and closer to one side wall than to the other side wall, the light assembly also included an interior illumination panel and an exterior illumination panel with exterior surfaces coplanar with the plastic sheets of the front panel and a lithium battery operatively coupled to the panels for the illumination thereof, the light assembly also having a first switch extendable upwardly of the upper edge of the front wall to inactivate the panels when the lid is in the closed orientation to depress the first switch and to allow the first switch to extend upwardly when the lid is in the opened orientation to activate the panels to illuminate interior and exterior of the cooler, the light assembly also having a second switch located adjacent to the exterior panel adapted to be pressed by a user to inactivate the panels and to activate the panels to illuminate interior and exterior of the cooler;

handles on the side panels adjacent to the opening for assisting a user in transporting the system;

a latch on the lid adjacent to the upper edge of the front wall for manipulation by a user in locking the lid in a closed orientation and unlocking the lid for movement to the opened orientation; and a drain plug in the rear wall adjacent to the bottom wall for assisting a user in draining the system.

2. A light assembly and cooler system:

a cooler formed with a front and rear wall with two end walls there between, with a bottom wall coupled to the lower edges of the front and rear and end walls, the front and rear and end walls forming a rectangular opening;

a lid with an outwardly extending periphery pivotally coupled to the lid, the lid adapted to rest in contact with the rectangular opening when the cooler is in a closed orientation, the lid adapted to be out of contact with the rectangular opening when the cooler is in an open orientation; and a light assembly including an interior illumination member having a switch operable to activate and inactivate the member while the lid is in the opened orientation and closed orientation.

3. A light assembly and cooler system comprising:

a cooler formed with a front and rear wall with two end walls there between, with a bottom wall coupled to the lower edges of the front and rear and end walls, the front and rear and end walls forming a rectangular opening;

a lid with an outwardly extending periphery pivotally coupled to the lid, the lid adapted to rest in contact with the rectangular opening when the cooler is in the closed orientation;

a light assembly including an interior illumination member having a switch operable to inactivate the interior illumination member when the lid is in the closed orientation; and an exterior illumination member and a second switch to be pressed by a user to inactivate both members and to activate both members to illuminate interior and exterior of the cooler, the interior and exterior members being located in an aperture extending through the front wall.

* * * * *